US005372097A

United States Patent [19]

Joseph et al.

[11] Patent Number: 5,372,097

[45] Date of Patent: Dec. 13, 1994

[54] SELF-LUBRICATING CAM FOLLOWER

[75] Inventors: Kenneth Joseph, New York; Tomi I. Trutescu, Richmond-Hill; Ioan I. Trutescu, Ozone-Park, all of N.Y.

[73] Assignee: Welles Manufacturing, Northvale, N.J.

[21] Appl. No.: 204,807

[22] Filed: Mar. 1, 1994

Related U.S. Application Data

[63] Continuation of Ser. No. 993,376, Dec. 18, 1992, abandoned.

[51] Int. Cl.[5] ..... F01L 1/18

[52] U.S. Cl. ..... 123/90.36; 123/90.39; 123/90.42

[58] Field of Search ..... 123/90.33, 90.27, 90.36, 123/90.39, 90.35, 90.41, 90.42, 90.43, 90.44, 90.45, 90.46, 90.47; 74/519, 559

[56] References Cited

U.S. PATENT DOCUMENTS

| | | | |
|---|---|---|---|
| 2,385,309 | 9/1945 | Spencer | 123/90.36 |
| 2,435,727 | 2/1948 | Spencer | 123/90.36 |
| 4,614,171 | 9/1986 | Malhotra | 123/90.39 |
| 4,697,473 | 10/1987 | Patel | 123/90.39 |
| 4,796,483 | 1/1989 | Patel et al. | 123/90.36 |
| 4,825,717 | 5/1989 | Mills | 123/90.39 |
| 4,829,647 | 5/1989 | Anderson et al. | 123/90.39 |
| 4,848,180 | 7/1989 | Mills | 123/90.39 |
| 4,940,048 | 7/1990 | Mills | 123/90.39 |
| 4,979,475 | 12/1990 | Mills | 123/90.39 |
| 5,010,856 | 4/1991 | Ojala | 123/90.36 |
| 5,016,582 | 5/1991 | Mills | 123/90.39 |
| 5,048,475 | 9/1991 | Mills | 123/90.39 |
| 5,123,384 | 6/1992 | Abbas | 123/90.39 |

*Primary Examiner*—E. Rollins Cross
*Assistant Examiner*—Weilun Lo
*Attorney, Agent, or Firm*—Handal & Morofsky

[57] ABSTRACT

A self-lubricating cam follower for an overhead cam internal combustion engine of the reciprocating piston-and-cylinder type has a generally upright U-section and an elongated body and is provided with a gravity feed ramp for oil to flow from a support end to a cam follower roller which is typically journaled in bearings in the cam follower. The oil flow serves to lubricate the cam follower, and especially its roller bearings. A lip at the support end of the follower retains oil in the cam follower body and a controlled clearance between a roller-accommodating cutout in the base and the roller, tends to force bearing lubrication. The novel self-lubricating characteristics of the inventive cam follower are operable in an engine having a piston-and cylinder disposed for substantially vertical relative movement and provide greater versatility in engine design.

8 Claims, 3 Drawing Sheets

Prior Art

SELF-LUBRICATING CAM FOLLOWER

This application is a continuation of application Ser. No. 07/993,376, filed Dec. 18, 1992, now abandoned.

TECHNICAL FIELD

The present invention relates to cam followers of the type used in overhead cam internal combustion engines to perform such tasks as operating intake and exhaust valves by translating driving impulses received from eccentric lobes on the cam into reciprocatory motion of the valve stems.

BACKGROUND

Cam followers like other parts of the internal combustion engine have been the subject of extensive variation and development. In addition to variations in useful configurations, cam followers have been made by numerous processes, including casting, stamping, forging and combinations of the same, including the use of machined parts such as needle bearings or the like.

Generally, cam followers are supported for pivotal movement in order to directly or indirectly receive the reciprocating drive provided by a camshaft which urges the cam follower against a spring biased member, resulting in the opening and closing of an intake or exhaust valve. Problems to be solved in engineering such cam followers include avoiding undue wear, reducing friction, and providing for ease of replacement.

An example of such a cam follower can be found in U.S. Pat. No. 4,697,473 to Patel which will be discussed in more detail in connection with the attached drawings. The Patel structure employs an elongated cam follower of inverted-U cross-section which supports a cam-engaging cam follower roller in bearings. The bearings transmit the valve-driving load, which has to be sufficient to compress the valve springs. Efficient lubrication of these bearings, and of any cam-engaging surfaces, is therefore critical to engine life. Such lubrication problems are exacerbated by modern standards of automobile durability which commonly expect passenger automobile engines to run 100,000 miles or more without failure or major service.

When the Patel cam follower is disposed at a substantial incline, it allows oil to flow over its back from a lifter post supporting one end of the cam follower towards the generally vicinity of the cam follower bearings. This requirement for an inclined cam follower has the drawback of restricting the applicability of the Patel structure to inclined engines in which one or more cylinder banks is substantially out of the vertical, as is the case in a V-aligned engine such as a V-6 or V-8 engine and of rendering it unsuitable for use in engines having one or more upright banks of cylinders. Such lubrication may also fail temporarily on extended banked curves or when climbing up hill (a situation where engine stress is maximized), depending upon the particular engine disposition, longitudinal or transverse.

As a safeguard lubrication through the cam is generally desirable with the Patel construction, a relatively expensive complication bringing further drawbacks.

SUMMARY OF THE INVENTION

The invention is intended to provide a remedy. It solves the problem of providing efficient and reliable lubrication for a cam follower throughout a wide range of dispositions of the cam follower, including a close-to-horizontal position. The ability to be effectively lubricated in a near-horizontal position extends the use of such an inventive cam follower, and its associated valve-actuating mechanism, to the actuation of the valves of an upright piston-and-cylinder bank from an overhead cam. Such an inventive cam follower, or structure embodying a cam follower, may be called a self-lubricating cam follower.

A further object of the invention is to provide an improved, self-lubricating cam follower which is economical to manufacture and can preferably be produced by forging or casting or a combination of such steps, followed by appropriate finishing and assembly with little, if any, need for expensive machining steps.

Accordingly, the invention provides a cam follower for an overhead cam internal combustion engine of the reciprocating piston-and-cylinder type, said engine comprising a rotatable cam equipped with valve actuating segments, a reciprocatory valve mechanism, and a cam follower support for an end of said cam follower, said support having a pressurized oil supply and said cam follower being operable to translate cam segment rotation into valve reciprocation and comprising:

a) an elongated body having a support end engageable with said support to be supported thereon and an active end engageable with said reciprocatory valve mechanism whereby said cam follower can pivot about said support and drive said valve mechanism in a reciprocatory manner;

b) a cam-engageable cam follower device mounted for movement on said body intermediately said support end and said active end to receive drive therefrom; and c) an oilway structure providing oil feed from said support to said cam follower device to lubricate its movement said oil feed being active in an engine position in which said piston movement is generally in a vertical direction.

Such an oilway structure enables the desirable prior art valve-actuating mechanism for an overhead cam engine to be employed in a wider range of engine designs than was heretofore possible. In addition, the provision of the defined oilway structure improves lubrication in out-of horizontal positions of the follower, such as are encountered in inclined-cylinder engines, and may obviate the need for through-cam lubrication, although such can be included with the present invention, if so desired.

Preferably, the cam follower device comprises a roller supported for rotation on bearings and said oilway structure comprises passages guiding oil downwardly from said cam follower support to said bearing structure under the influence of gravity. A roller is a preferred form of cam follower device. However, its bearings are subject to considerable stress and must be efficiently lubricated, which said oil-guiding passages provide.

In a preferred embodiment, the cam follower has, in a somewhat horizontal and operative position of the cam follower, an upwardly facing surface which extends beneath said bearings. This upwardly facing surface can present a downwardly inclined ramp in said upright position of said cam follower support.

In a preferred structure, the cam follower has a cutout to accommodate said cam follower roller and said upwardly facing surface adjoins said roller with a small oil-retaining clearance. This clearance assists application of oil to the roller and thence, interacting with the upwardly facing surface which is normally oil coated, assists migration of oil to the bearings supporting the roller.

The advantages of the invention extend to a cylinder head for an overhead cam internal combustion engine of the reciprocating piston-and-cylinder type, said engine comprising a rotatable cam, said cylinder head being equipped with valve actuating segments, a reciprocatory valve mechanism, and a cam follower support for an end of said cam follower, said support having a pressurized oil supply and said cam follower being operable to translate cam segment rotation into valve reciprocation wherein said cam follower is an inventive cam follower as described above. Such a cylinder head can be used for an upright cylinder bank while providing adequate lubrication.

Greater engine design flexibility is obtainable by employing the inventive cam follower in an overhead cam internal combustion engine of the reciprocating piston-and-cylinder type, said engine comprising a rotatable cam equipped with valve actuating segments, a reciprocatory valve mechanism, and a cam follower support for an end of the inventive cam follower, said support having a pressurized oil supply and said cam follower being operable to translate cam segment rotation into valve reciprocation.

In contrast with the prior art cam follower which has to be substantially inclined for effective lubrication, the follower of this invention can operate in a nearly horizontal position. Also, the prior art cam follower of Patel requires lubrication through the cam, the necessity for which is avoided by means of the present invention which provides thoroughly adequate lubrication not only of the follower and its bearings, but also of the proximate cam surfaces.

BRIEF DESCRIPTION OF THE DRAWING

One way of carrying out the invention is described in detail below with reference to drawings which illustrate a specific embodiment of the invention and in which.

BEST MODE FOR CARRYING OUT THE INVENTION

To facilitate an understanding of the invention, the prior art valve-actuating mechanism shown in FIG. 1 will first be described. The construction depicted here is suitable for an engine having a normally inclined cylinder bank, such for example as an inclined four, a V-6 or a V-8. In general, while not limited thereto, the invention is primarily applicable to internal combustion engines for automobiles.

Figure 1:
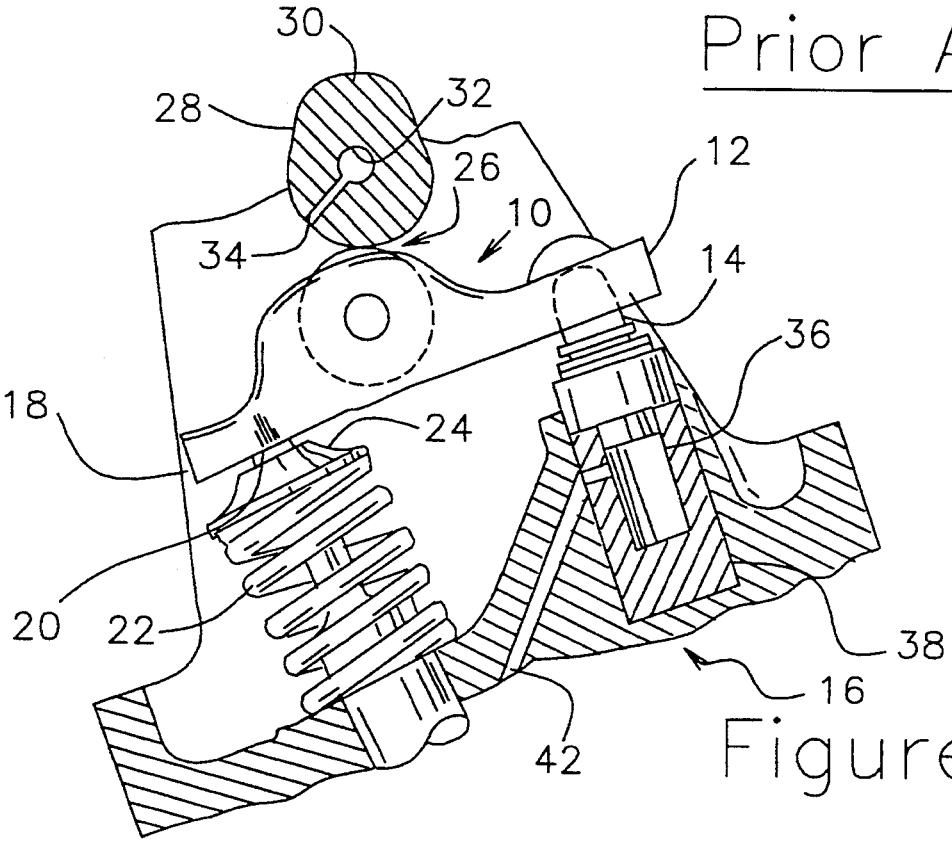
FIG. 1 is a schematic view, partly in section, of a valve-actuating mechanism for an overhead cam internal combustion engine showing the function and disposition of a prior art cam follower, which is substantially in accordance with Patel U.S. Pat. No. 4,697,473.

Referring to FIG. 1 a cam follower 10 has a supporting end 12 seated on a lifter post 14 which post 14 extends upwardly from a cylinder head 16. An active end 18 of the cam follower 10 engages an upper end of a valve stem 20 which also extends upwardly from cylinder head 16, in this case, through a compressible valve spring 22. Valve spring 22 acts between the cylinder head 16 and a retainer ring 24 mounted on the valve stem 20 to urge closure of the valve at its lower end in the combustion chamber (not shown), and also to support and urge the upper end of valve stem 20 into engagement with active end 18 of cam follower 10.

Intermediately the length of the cam follower 10, a cam follower roller 26 is engaged by an overhead cam 28 which is rotated by a drive from the engine. An eccentric timing lobe 30 acts on the roller 26 depressing the cam follower 10 in a pivoting manner about lifter post 14. The active end 18 of cam follower 10 drives the valve stem 20 downwardly against valve spring 22 to open the valve, which returns to a closed position under influence of the valve spring 22 when the cam follower roller 26 finds the dwell portion of the cam profile.

In this prior art construction, oil is supplied through a central passage 32 in the cam 28 and through radial bleed holes such as 34 whence it flows to the intermediate surface of the cam follower 10 for lubricating purposes. Such a construction is often known as an inverted cam follower design because the cam follower is beneath the cam rather than riding on top of it.

The lifter post 14 is slidably carried in a chamber 36 formed in an insert 38 in cylinder head 16 where it is cushioned by pressurized oil admitted into chamber 36 through a small port 40 from a supply passage 42. Also called a lash adjuster, the lifter post 14 is thus enabled to yield to a limited extent in response to a down thrust from the advancing cam lobe 30 to provide a zero lash adjustment for the cam follower 10. Such movement may be of the order of 20 or 30 thousandths of an inch. Small port 40 is dimensioned to provide controlled leakage of oil from the chamber 36 to limit the pressure of the oil therein. Limited quantities of oil can also reach the intermediate surface of the cam follower 10, in the vicinity of the roller 26, by upward leakage over the lifter post 14 and gravity feed down the inner side walls of the cam follower 10, when the cam follower is in an inclined position, as shown in FIG. 1. Repeated small movements of the lifter post 14 as the cam 28 rotates, generates a pumping action to move the oil.

Clearly, such gravity feed will not be effective if the cam follower 10 is substantially horizontal, as it would be in an upright straight-aligned engine, or in an inclined cylinder bank when climbing or cornering. Accordingly, for this and other reasons, the cam follower roller 36 is also lubricated through the cam 28, a not-always-reliable arrangement that substantially increases the expense of the cam.

For economy and efficiency of manufacture, the cam follower 10 is made by cold-forming operations including stamping, coining, staking and back-packing. The cam follower 10 typically includes a one-piece metal body of inverted U-shaped cross-section substantially throughout its length. A cam follower roller is journaled in the side walls of the cam follower and projects upwardly through an opening in the cam follower body.

Figure 2:
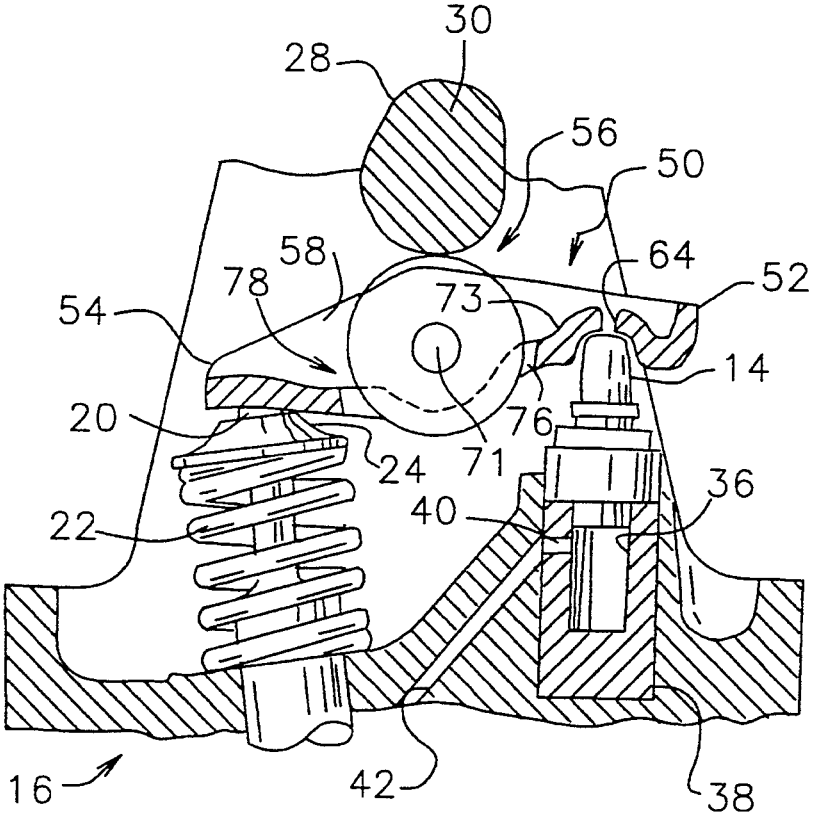
FIG. 2 is a view similar to FIG. 1 of a valve-actuating mechanism employing a self-lubricating cam follower according to the present invention.
Figure 3:
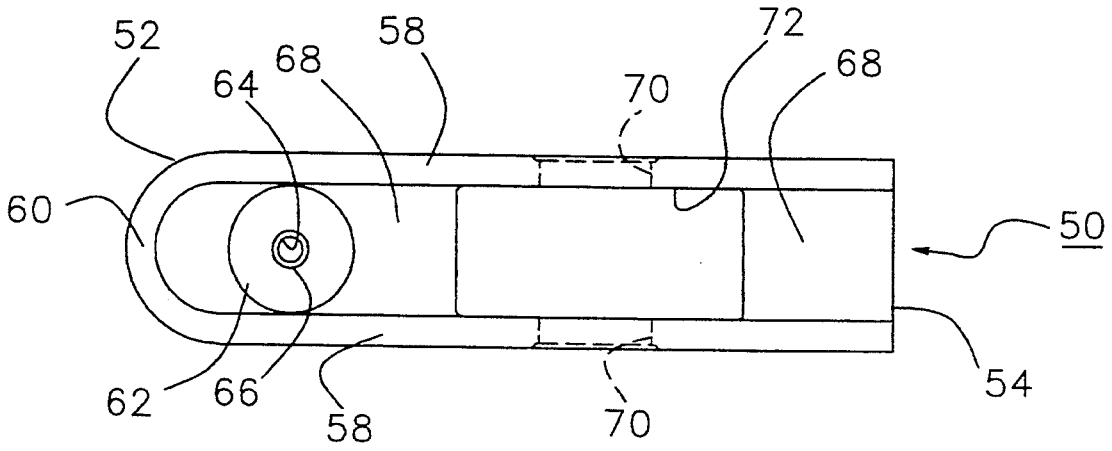
FIG. 3 is a top plan view, enlarged and rotated left to right, of the inventive cam follower employed in the valve-actuating mechanism of FIG. 2 with its cam follower roller removed.
Figure 4:
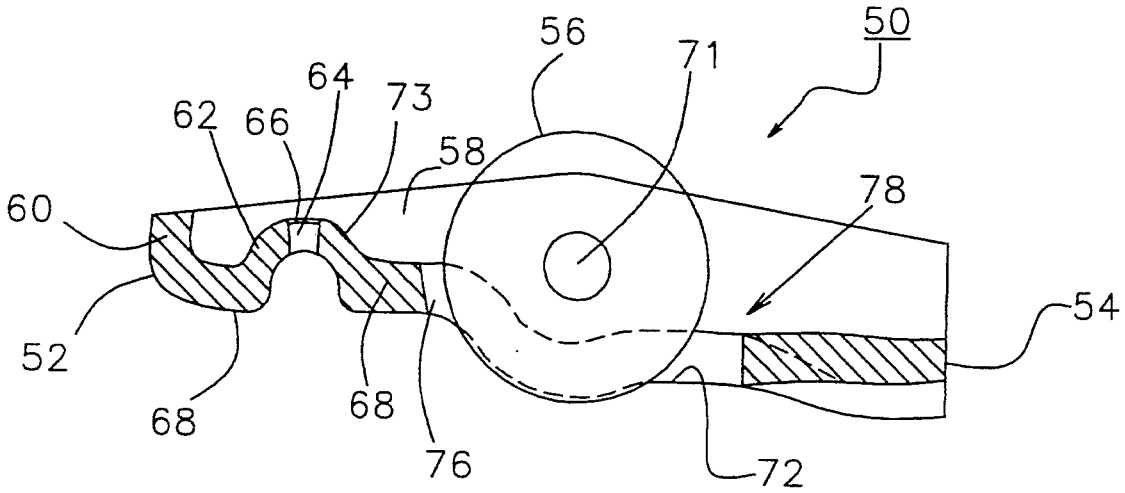
FIG. 4 is a section on the line 4—4 of FIG. 3, with a cam follower roller in position.
Figure 5:
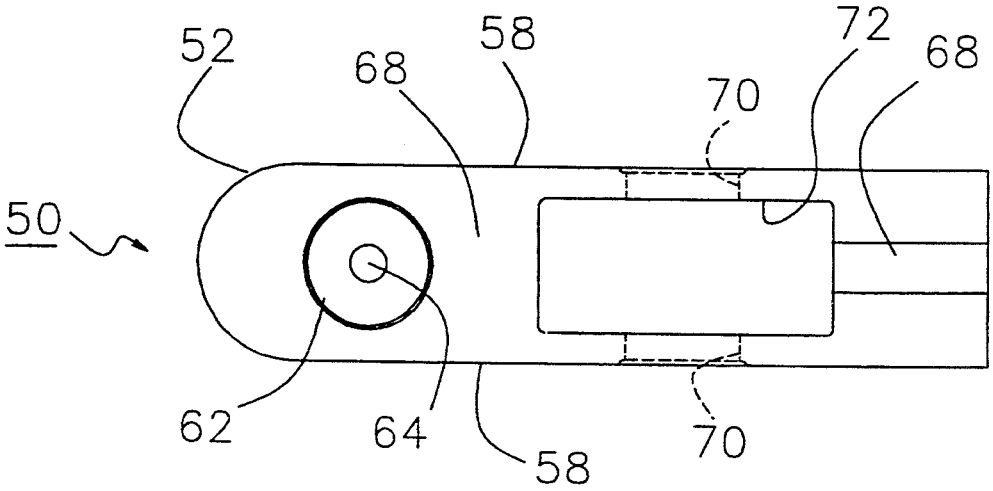
FIG. 5 is an underneath plan view of the cam follower shown in FIGS. 3–4 without the roller.
Figure 6:
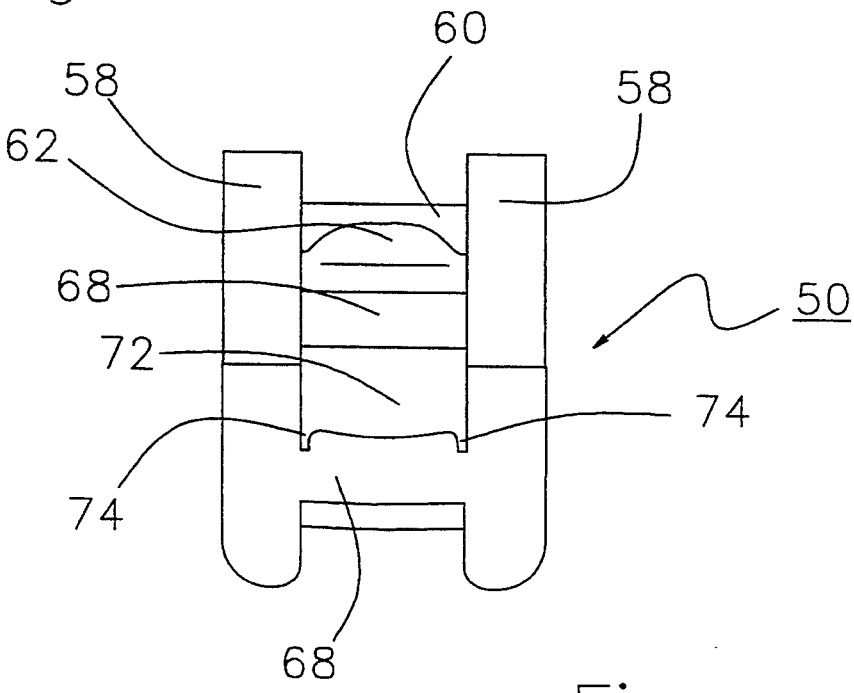
FIG. 6 is a right-hand end elevation of the cam follower shown in FIG. 4, also without the roller.

Turning to FIG. 2, where similar valve-actuating engine components have been given similar reference numerals, an inventive, self-lubricating cam follower 50 is operable in a similar valve-actuating mechanism to that of FIG. 1 with similar results and provides the additional benefit of being self lubricating, even when substantially horizontal, as depicted in FIG. 2. The cam follower 50 can therefore be used in a wider range of applications, including upright, straight-aligned engines.

Self-lubricating cam follower 50 has a supporting end 52, an active end 54 and a cam follower roller 56 the latter being journaled in side walls 58. More structural details are apparent from the several views of FIGS. 3–6. In transverse section, perpendicular to the plane of the paper as shown in FIG. 2, the cam follower 50 has an upright U-section, referring to the normal disposition of an engine containing the shown valve-actuating mechanism, so that it is upwardly open, in contrast to the prior art cam follower 10. The supporting end 52 comprises a curved oil-retaining lip 60, and, within the body of the cam follower 50, a domed cap 62 which fits snugly over lifter post 14. Cap 62 has a central orifice 64 for the passage of oil and is chamfered at 66 to encourage its flow. Domed cap 62 is raised from a base 68 of cam follower 50 and extends in a web-like manner between side walls 58.

Centrally of base 68, the cam follower has a substantial rectangular cutout 72 which accommodates cam follower roller 56. The cam follower roller 56 is journaled in bearings 71 which may, for example, be needle bearings, and the bearings 71 are accommodated in recesses or openings 70, if preferred with employment of a ball race, if preferred. Cam follower roller 56 projects above the side walls 58 for engagement with overhead cam 28 and its lower surface extends just below base 68 to assist in the distribution of oil. Towards the cam follower roller 56, cap 62 and base 68 present a downward ramp 73 for the flow of oil, preferably with gravitational assistance, towards the cam follower roller and its sensitive bearings 71. A clearance 76 at the end of this ramp adjacent the roller 56 is small enough to allow oil to be drawn on to the roller 56 and to migrate to its bearings 71.

At the active end 54 of the cam follower 50, the base 68 is crimped upwardly between side walls 58 to provide a sturdy channel that accommodates and rides on the upper end of valve stem 20. The crimping of base 68 provides small gullies 74 to encourage oil flow.

In operation, as best seen in FIG. 2, the cam follower 50 reliably and effectively transmits rotation of the overhead cam 28 with its eccentric lobe 30 into reciprocating opening and closing movement of the valve stem 20 with lubrication of the cam follower roller 56 in a wide range of positions. Such effective operational positions include a nearly horizontal position in which the lifter post 14, which is usually roughly parallel to the direction of engine piston movement, is substantially vertical, approximately as shown in FIG. 2.

Pressurized oil is cyclically forced out of chamber 36 as cam lobe 30 rotates, and up over lifter post 14 in the vicinity of the underside of domed cap 62. Oil arriving at the top of the lifter post 14 enters an oilway leading up through orifice 64, down ramp 73 and into clearance 76 where oil is retained within the cam follower 50 to surround or bathe the cam follower roller 56 and thence access and coat its bearings 71. Curved lip 60 helps retain oil in the cam follower 50, providing a small reservoir for feed down the ramp 73 towards the cam follower roller 56. On one stroke, gullies 74 help small quantities of oil move out and around the active end 54 of the cam follower 50 to its underside where the cam follower rides on the valve stem 20. Excesses of oil may be returned towards the cam follower roller 56 on an opposite stroke, depending on the precise disposition of the parts and the engine speed.

Depending upon the extent to which it is desired also to apply oil to the upwardly projecting valve components, a clearance 78 of the rectangular cutout 72 at the other side of the cam follower roller 56 from clearance 76 can be greater to release oil, or lesser to retain it around the cam follower roller 56. Oil reaching the cam follower roller 56 is also helpful in lubricating the engagement of the roller 56 with the cam 28 which accordingly can dispense with oil passage 32 and bleed hole 34 (FIG. 1), if desired, although such additional lubrication can, of course also be supplied.

In the position of FIG. 2, ramp 73 has a pronounced downward cast favoring downward movement of oil, and clearly this cast will still be somewhat downward in an engine position in which valve lifter 14 is tilted somewhat to the right or a great deal to the left. In this horizontal position the bearings 71 are somewhat below the upper end of orifice 64 where pressure from the chamber 36 is released so that they can receive oil therefrom for lubrication by gravity feed enhanced by the rapid pivoting motion of the cam follower 50.

The above-described self-oiling characteristics of the inventive cam follower 50 provide a smooth-operating, long-lived device. Furthermore it permits a new engine design in which the described overhead cam valve-actuating mechanism is incorporated in an upright cylinder bank.

Structurally, the design of the inventive cam follower 56 provides good rigidity and support for the cam follower roller 56, with efficient translation of cam lobe 30 passes into reciprocatory valve action. Furthermore, the simple, open configuration is well suited to economical production, for example by forging, casting or stamping for example from a steel such as a carbonitride treated steel.

A cylinder head of an internal combustion engine of the overhead valve type can be enhanced by incorporation of inventive self-lubricating cam followers such as the embodiment described and shown herein. Durability or flexibility of application or both are improved.

While illustrative embodiments of the invention have been described above, it is, of course, understood that various modifications will be apparent to those of ordinary skill in the art. Such modifications are within the spirit and scope of the invention, which is limited and defined only by the appended claims.

We claim:

1. A cam follower for an overhead cam internal combustion engine of the reciprocating piston-and-cylinder type, said engine comprising a rotatable cam equipped with valve actuating segments, a reciprocatory valve mechanism, and a cam follower support for an end of said cam follower, said support having a pressurized oil supply and said cam follower being operable to translate cam segment rotation into valve reciprocation and comprising:

a) an elongated body for supporting a cam-engagable cam follower roller, said body having a support end engagable with said support to be supported thereon and an active end engageable with said reciprocatory valve mechanism whereby said cam follower can pivot about said support and drive said valve mechanism in a reciprocatory manner, said elongated body and said cam follower roller forming a configuration for maintaining an oil reservoir between said support end and said active end;

b) said cam-engageable cam follower roller supported on said body for rotation on bearings, intermediately of said support end and said active end, in the vicinity of said oil reservoir whereby said roller rotates through oil in said oil reservoir; and c) oil-retaining structure providing oil feed from said support to said cam follower roller to lubricate said cam follower roller, said oil-retaining structure having means to retain oil received from said cam follower support within said elongated body oil reservoir for substantially gravity-independent transport of said oil in said reservoir to said cam follower roller bearings; whereby said oil-retaining structure if active to lubricate said cam follower roller bearings from said pressure-oil cam follower support in a generally vertical engine position having regard to the direction of piston movement.

2. A cam follower according to claim 1 wherein said oil transport from said elongated body oil reservoir to said cam roller bearings is effected by viscous traction.

3. A cam follower according to claim 1 wherein said oil reservoir structure has, in a somewhat horizontal and operative position of the cam follower, an upwardly facing surface which extends beneath said bearings.

4. A cam follower according to claim 1 wherein said oil-retaining structure comprises an upstanding retaining lip extending continuously around said support end to retain oil in said oil reservoir on said cam follower elongated body.

5. A cam follower according to claim 1 wherein said oil-retaining structure further comprises, in a somewhat horizontal and operative position of said cam follower, an upwardly facing surface which extends beneath said bearings and an upstanding retaining lip around said support end to retain oil on said cam follower and wherein said cam follower body has a cutout to accommodate said cam follower roller said cam follower body adjoining said cam follower roller with a small, oil-retaining clearance across which oil is viscously transportable to said cam follower roller and said bearings whereby said cam follower body has a generally dished configuration to face upwardly toward said cam.

6. A cam follower according to claim 1 wherein said cam follower body has a cutout to accommodate said cam follower roller said cutout having an edge facing said cam follower roller and wherein said oil-retaining structure includes a small, oil-retaining clearance between said cutout edge and said cam follower roller, said small clearance being dimensioned to enable oil to be retained within said reservoir and viscously transported across said clearance to said cam follower roller and thence to said bearings.

7. A cylinder head for an overhead cam internal combustion engine of the reciprocating piston-and-cylinder type, said engine comprising a rotatable cam equipped with valve actuating segments, said cylinder head comprising a reciprocatory valve mechanism, an elongated cam follower and a cam follower support for an end of said cam follower, said support having a pressurized oil supply and said cam follower being operable to translate cam segment rotation into valve reciprocation wherein said cam follower comprises:

a) an elongated body for supporting a cam-engagable cam follower roller, said body having a support end engageable with said support to be supported thereon and an active end engageable with said reciprocatory valve mechanism whereby said cam follower can pivot about said support and drive said valve mechanism in a reciprocatory manner, said elongated body and said cam follower roller forming a configuration for maintaining an oil reservoir between said support end and said active end;

b) said cam-engageable cam follower roller supported on said body for rotation on bearings, intermediately of said support end and said active end, in the vicinity of said oil reservoir whereby said roller rotates through oil in said oil reservoir; and c) oil-retaining structure providing oil feed from said support to said cam follower roller to lubricate said cam follower roller, said oil-retaining structure having means to retain oil received from said cam follower support within said elongated body oil reservoir for substantially gravity-independent transport of said oil in said reservoir to said cam follower roller bearings;

whereby said oil-retaining structure is active to lubricate said cam follower roller bearings from said pressurized-oil cam follower support in a generally vertical engine position having regard to the direction of piston movement.

8. An overhead cam internal combustion engine of the reciprocating piston-and-cylinder type, said engine comprising a rotatable cam equipped with valve actuating segments, a reciprocatory valve mechanism, an elongated cam follower and a cam follower support for an end of said cam follower, said support having a pressurized oil supply and said cam follower being operable to translate cam segment rotation into valve reciprocation wherein said cam follower comprises:

a) an elongated body for supporting a cam-engagable cam follower roller, said body having a support end engageable with said support to be supported thereon and an active end engageable with said reciprocatory valve mechanism whereby said cam follower can pivot about said support and drive said valve mechanism in a reciprocatory manner, said elongated body and said cam follower roller forming a configuration for maintaining an oil reservoir between said support end and said active end;

b) said cam-engageable cam follower roller supported on said body for rotation on bearings, intermediately of said support end and said active end, in the vicinity of said oil reservoir whereby said roller rotates through oil in said oil reservoir; and c) oil-retaining structure providing oil feed from said support to said cam follower roller to lubricate said cam follower roller, said oil-retaining structure having means to retain oil received from said cam follower support within said elongated body oil reservoir for substantially gravity-independent transport of said oil in said reservoir to said cam follower roller bearings;

whereby said oil-retaining structure is active to lubricate said cam follower roller bearings from said pressurized-oil cam follower support in a generally vertical engine position having regard to the direction of piston movement.

* * * * *